US011327444B2

(12) United States Patent
Mishima et al.

(10) Patent No.: US 11,327,444 B2
(45) Date of Patent: May 10, 2022

(54) WATCH

(71) Applicant: SEIKO EPSON CORPORATION, Tokyo (JP)

(72) Inventors: Yoshio Mishima, Matsumoto (JP); Atsushi Kobayashi, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 701 days.

(21) Appl. No.: 16/273,599

(22) Filed: Feb. 12, 2019

(65) Prior Publication Data

US 2019/0250564 A1 Aug. 15, 2019

(30) Foreign Application Priority Data

Feb. 14, 2018 (JP) ..... JP2018-023779

(51) Int. Cl.
*G04B 37/14* (2006.01)
*A44C 5/16* (2006.01)

(52) U.S. Cl.
CPC ..... *G04B 37/1493* (2013.01); *A44C 5/16* (2013.01)

(58) Field of Classification Search
CPC ..... G04B 37/1493; A44C 5/16
See application file for complete search history.

(56) References Cited

U.S. PATENT DOCUMENTS 5,363,351 A 11/1994 Carney
6,406,177 B1 * 6/2002 Fukushima ..... A44C 5/10 368/281
2003/0035347 A1 * 2/2003 Yokosuka ..... G04B 37/1493 368/281
2017/0102672 A1 * 4/2017 Martin ..... G04B 23/00
2017/0276564 A1 * 9/2017 Takeuchi ..... G01C 5/06
2019/0094810 A1 * 3/2019 Kobayashi ..... G04G 17/08

FOREIGN PATENT DOCUMENTS

CH 713974 A2 * 1/2019 ..... A44C 5/24
DE 1066776 B 8/1958
FR 2748373 A1 11/1997
JP S54-84974 U 6/1979
JP H01-145003 A 6/1989
JP H09-051808 A 2/1997
JP H11-183658 A 7/1999
(Continued)

OTHER PUBLICATIONS

Machine Translation of CH713974 (Year: 2021).*
(Continued)

*Primary Examiner* — Edwin A. Leon
*Assistant Examiner* — Jason M Collins
(74) *Attorney, Agent, or Firm* — Oliff PLC

(57) ABSTRACT

A watch includes a case, a first spring bar support portion and a second spring bar support portion which are provided on the case. Further included is a spring bar supported by the first spring bar support portion and the second spring bar support apportion, a cover member into which the spring bar is inserted and which is between the first spring bar support portion and the second spring bar support portion. The cover member entirely surrounds a circumference of the spring bar. A band is provided between the cover member and the case.

14 Claims, 7 Drawing Sheets

(56) References Cited

FOREIGN PATENT DOCUMENTS

| | | | |
|---|---|---|---|
| JP | 2003222690 A | * | 8/2003 |
| JP | 2009025321 A | * | 2/2009 |

OTHER PUBLICATIONS

Machine Translation of JP2003222690 (Year: 2021).*
Jul. 18, 2019 Extended European Search Report and Opinion on Patentability issued in European Patent Applcation No. 19 15 6644.7.
Mon Bracelet Nato; "Bracelet Nato: comments l'installer?;" www.youtube.com/watch?v=IP88zBAe6dQ; Jun. 11, 2015.

* cited by examiner

WATCH

BACKGROUND

This application claims priority to JP 2018-023779, filed on Feb. 14, 2018, which is hereby incorporated by reference in its entirety.

1. Technical Field

The present invention relates to a wearable apparatus such as a watch.

2. Related Art

A spring bar for attaching a watch band to bows (band support portion) of a watch case has been known. The watch band is inserted into a band passing hole consisting of the watch case (case body) and the spring bar (bridge portion) (see JP-A-1-145003).

However, the watch band is directly inserted into the band passing hole in JP-A-1-145003, thus friction between the watch band and the spring bar is caused by movement of the watch band in accordance with, for example, the user's motion, whereby the watch band may be deteriorated (worn away).

SUMMARY

A watch according to an aspect of the invention includes a case; a first spring bar support portion and a second spring bar support portion which are provided at one end of the case; a spring bar supported by the first spring bar support portion and the second spring bar support portion; a cover member into which the spring bar is inserted and which is disposed between the first spring bar support portion and the second spring bar support portion; and a band disposed between the cover member and the case.

It is preferable that a magnetic sensor is housed in the case, and the case, the spring bar, and the cover member are made of a titanium material.

It is preferable that the case includes a back cover and a cover glass, and the spring bar is provided between an imaginary plane extending from an outer surface of the back cover and an imaginary plane extending from an outer surface of the cover glass.

It is preferable that the cover member has a chamfer portion at an end edge portion of the cover member.

It is preferable that a distance between the cover member and the case is longer than a dimension of the band in a thickness direction.

It is preferable that a distance between the cover member and the case is shorter than a dimension of the band in a thickness direction.

It is preferable that the cover member has a cylindrical shape.

It is preferable that the cover member has a notch portion at an end edge portion of the cover member.

It is preferable that the spring bar includes expandable portions which are provided with a first flange and a second flange, respectively, and a dimension of the cover member in a longitudinal direction is longer than a distance from the first flange to the second flange when the expandable portions expand and contract.

BRIEF DESCRIPTION OF THE DRAWINGS

The invention will be described with reference to the accompanying drawings, wherein like numbers reference like elements.

DESCRIPTION OF EXEMPLARY EMBODIMENTS

A watch with a magnetic sensor will be described as a watch according to an embodiment of the invention with reference to the drawings.

Figure 1:
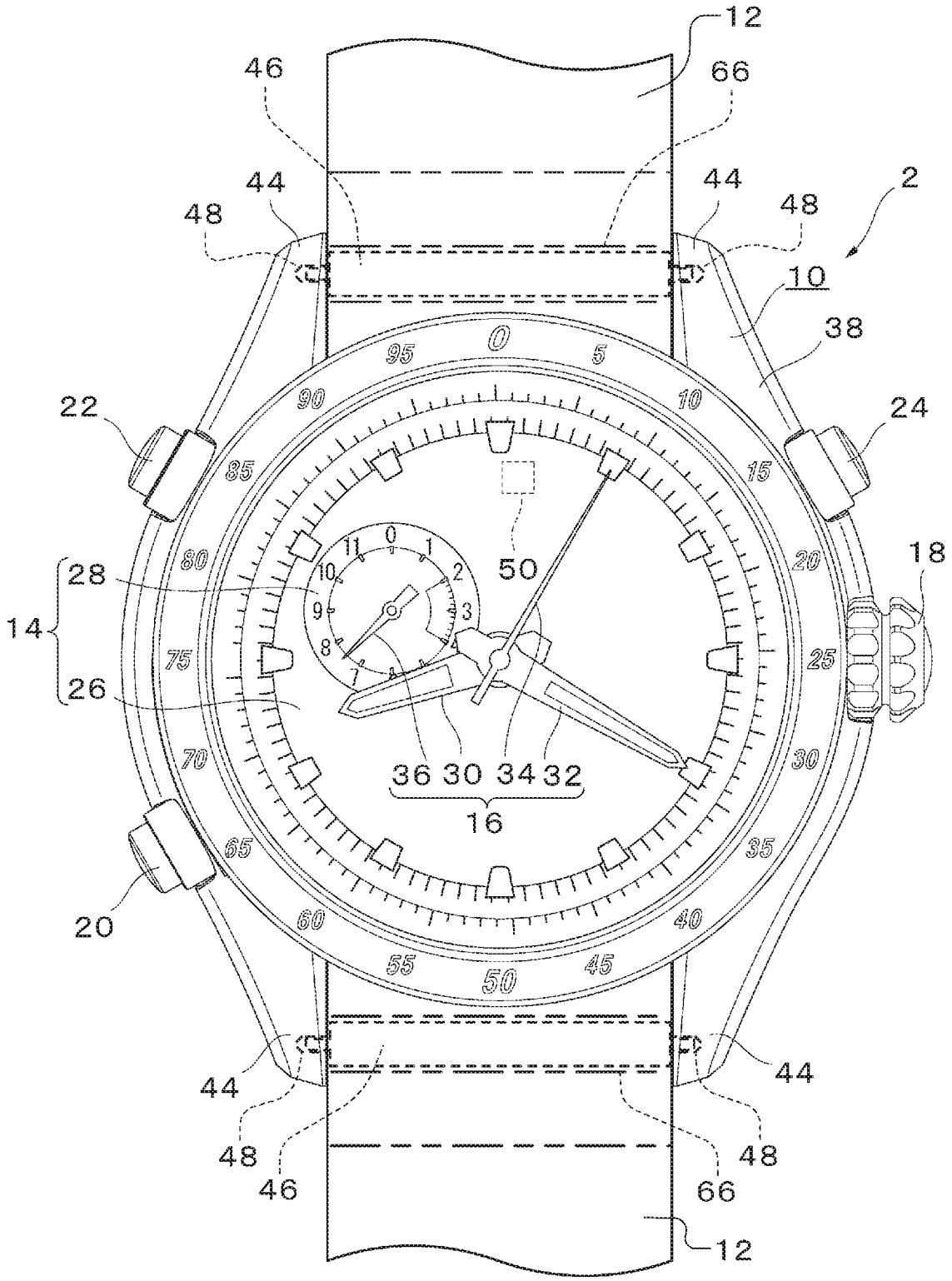
FIG. 1 is a front view illustrating a watch with a magnetic sensor according to an embodiment.
Figure 2:
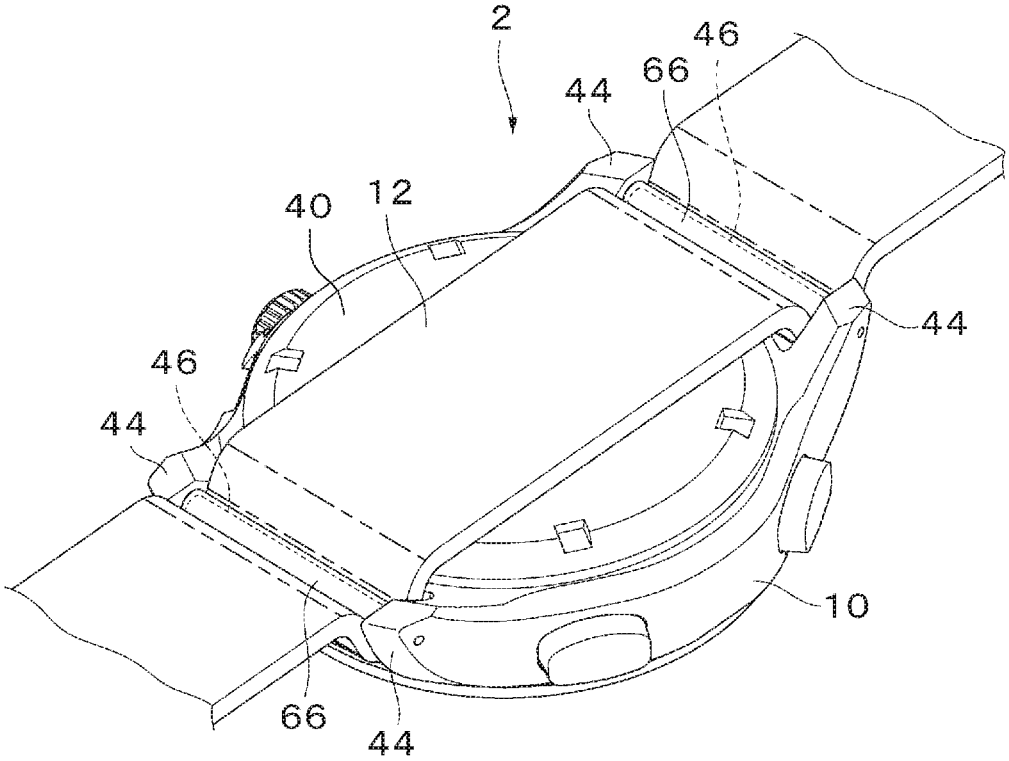
FIG. 2 is a perspective view illustrating the watch with the magnetic sensor according to the embodiment.

FIG. 1 is a front view illustrating a watch with a magnetic sensor according to an embodiment. FIG. 2 is a perspective view illustrating the watch with the magnetic sensor according to the embodiment.

The watch 2 with the magnetic sensor (hereinafter referred to as "watch 2") according to the embodiment is a wrist watch worn on the user's wrist. The watch 2 includes an exterior case 10 as a case; a pair of bows 44 as a first spring bar support portion and a second spring bar support portion, which are provided on the exterior case 10; spring bars 46 supported by the pair of bows 44; a cover member 66 into which the spring bar 46 is inserted and which is provided between the pair of bows 44; and a pull-through band 12 (hereinafter referred to as "band 12") as a band disposed between the cover member 66 and the exterior case 10, as shown in FIGS. 1 and 2. The exterior case 10 is provided with a movement (not shown), a disc-shaped dial 14, and pointers 16, as well as a crown 18, an A button 20, a B button 22, and C button 24 which are manipulation members.

The dial 14 is provided with a main dial 26 and a sub dial 28. The pointers 16 include center hands (an hour hand 30, a minute hand 32, and an orientation indicator 34) which instruct the main dial 26, and a small second hand 36 which instructs the sub dial 28. The hour hand 30, the minute hand 32, the orientation indicator 34, and the small second hand 36 are respectively driven by motors provided in the movement.

In the watch 2 according to the embodiment, a magnetic sensor 50 is disposed at a position closer to twelve o'clock on the dial 14 as viewed from a plane intersecting ("perpendicular to" in a narrow sense) a plane of the dial 14, visually recognizable by the user, as shown in FIG. 1. The magnetic sensor 50 is built in the exterior case 10. When a compass mode for indicating the azimuth is selected by the manipulation of the manipulation member, the magnetic sensor 50 is operated to measure the azimuth, and the orientation indicator 34 indicates a direction of "north" based on the measurement result.

The pair of bows 44 to which the band 12 is attached are provided on the twelve o'clock side and the six o'clock side of a case band 38, respectively. The pair of bows 44 are provided on the exterior case 10. Bow holes 48 into which the spring bars 46 are inserted are provided on opposing surfaces at which the pair of bows 44 face to each other. The spring bar 46 is supported by the pair of the bows 44.

The band 12 is configured as a non-metallic pull-through band such as a leather band, a resin band, a silicon band or the like. The band 12 may be knitted with polyamide-based synthetic fibers, leathers, rubbers and wires. The band 12 may be a metallic band. Furthermore, the band 12 is not limited to a metallic band, but may be a leather band or a resin band (a urethane band, a nylon band or a silicon band). That is, any type of the band 12 is acceptable as long as the band 12 is a band that can be fixed using the spring bars 46. The band 12 is disposed between the cover member 66 and the exterior case 10. The band is inserted from a space between the exterior case 10 and the spring bar 46 on the twelve o'clock side of the exterior case 10 to a space between the exterior case 10 and the spring bar 46 on the six o'clock side via a part of a back cover 40, and is attached to the exterior case 10.

Figure 3:
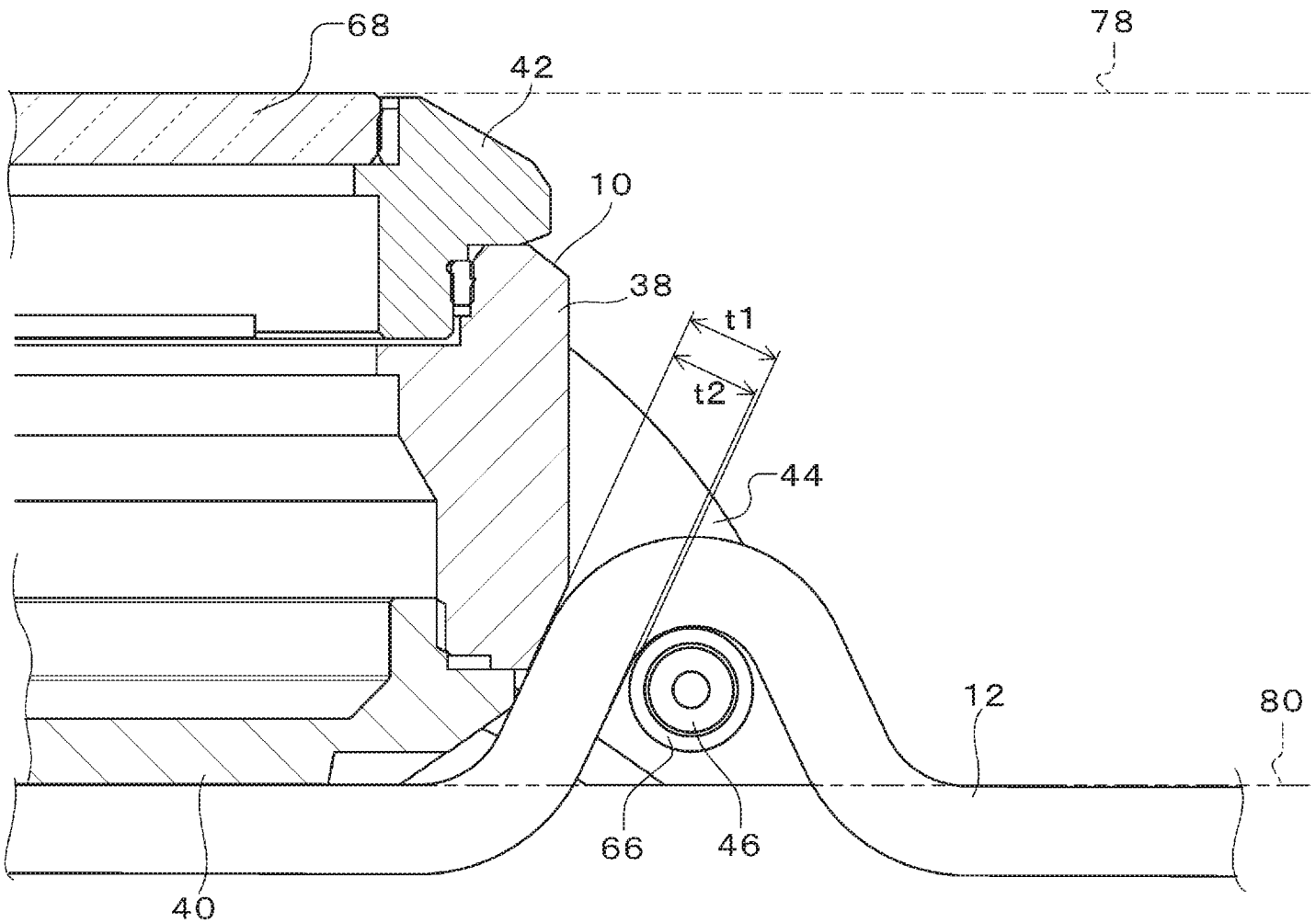
FIG. 3 is an enlarged cross-sectional view illustrating an attachment structure of a pull-through band according to the embodiment.

FIG. 3 is an enlarged cross-sectional view illustrating an attachment structure of the band 12 according to the embodiment.

The exterior case 10 is provided with a case band 38, a back cover 40 and a bezel 42, as shown in FIG. 3. These components are made of a titanium material such as pure titanium. The case band 38 and the back cover 40 may be integrally formed. The exterior case 10 is provided with a transparent cover glass 68 provided on a front side of the exterior case 10. The cover glass 68 is made of glass, resin, ceramics, sapphire or the like. Furthermore, the cover glass 68 may be made of a composite material which is a combination of glass, resin, ceramics, sapphire and the like.

It is preferable that the spring bar 46 is provided between an imaginary plane 78 extending from an outer surface of the back cover 40 and an imaginary plane 80 extending from an outer surface of the cover glass 68. Accordingly, the band 12 is curved between the exterior case 10 and the cover member 66, thus the exterior case 10 can be stably held with respect to the band 12. Furthermore, in a case where the back cover is not provided on a rear side of the exterior case (that is, in a case where the case band 38 and the back cover 40 are integrally formed), the imaginary plane 78 may be a plane extending from an outer surface on the rear side of the exterior case.

It is preferable that the cover member 66 is provided between the imaginary plane 78 extending from the outer surface of the back cover 40 and the imaginary plane 80 extending from the outer surface of the cover glass 68. Accordingly, the band 12 is curved between the exterior case 10 and the cover member 66, thus the exterior case 10 can be stably held with respect to the band 12. When the cover member 66 is provided between the imaginary plane 78 extending from the outer surface of the back cover 40 and the imaginary plane 80 extending from the outer surface of the cover glass 68, the band 12 is further curved between the exterior case 10 and the cover member 66, thus the exterior case 10 can be more stably held with respect to the band 12, as compared with a case where only the spring bar 46 is provided between the imaginary plane 78 extending from the outer surface of the back cover 40 and the imaginary plane 80 extending from the outer surface of the cover glass 68. Furthermore, in a case where the back cover is not provided on the rear side of the exterior case (that is, in a case where the case band 38 and the back cover 40 are integrally formed), the imaginary plane 78 may be a plane extending from the outer surface on the rear side of the exterior case.

The imaginary planes 78 and 80 are defined on the premise that the back cover 40 and the cover glass 68 are substantially flat. However, at least one of the back cover 40 and the cover glass 68 may be curved or provided with projection portions. In this case, an imaginary plane parallel to the dial 14 may be defined with reference to a portion of the outer surface of the back cover 40 or the cover glass 68, which is most distant from the dial 14.

Configuration of Cover Member

Figure 4:
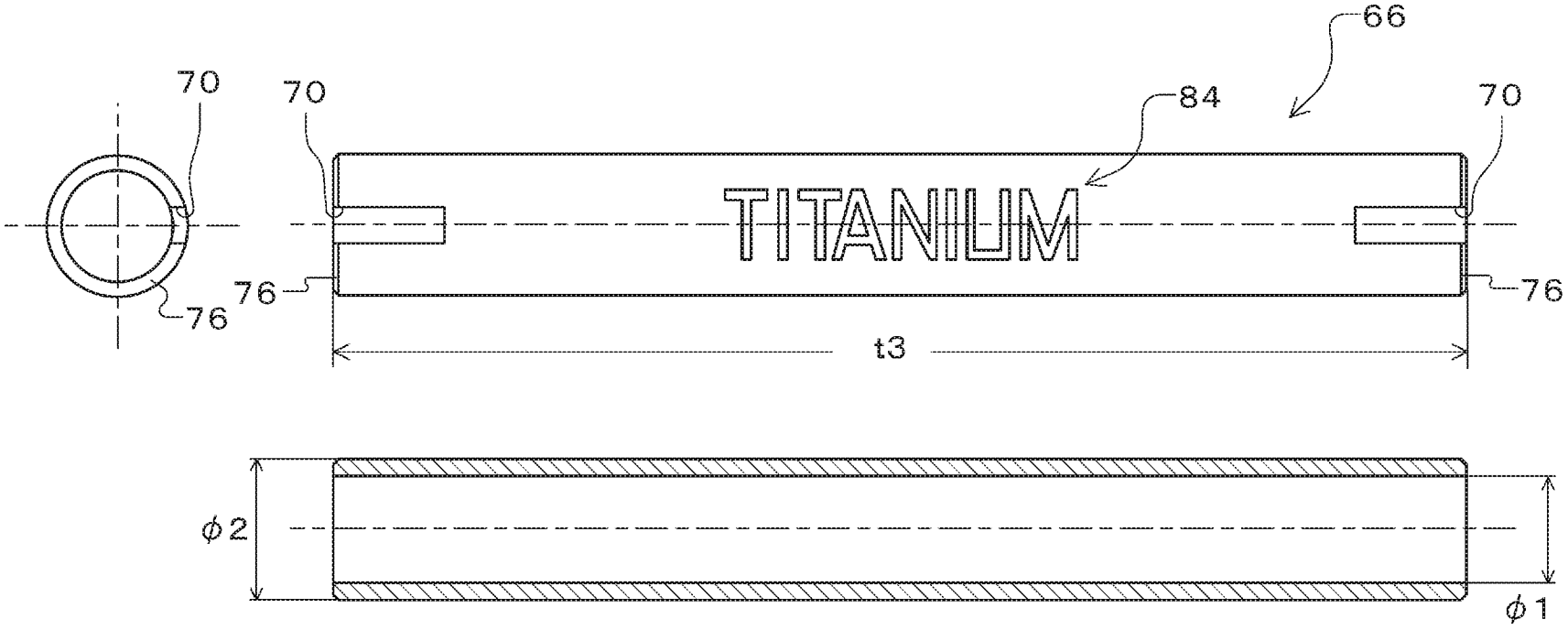
FIG. 4 shows a front view, a side view, and a cross-sectional view each of which illustrates a cover member according to the embodiment.

FIG. 4 shows a front view, a side view, and a cross-sectional view each of which illustrates a cover member 66 according to the embodiment.

The cover member 66 has a hollow shape as shown in FIG. 4, into which the spring bar 46 can be inserted. The cover member 66 is rotatable with respect to the spring bar 46.

It is preferable that the cover member 66 has a cylindrical shape. Accordingly, the cover member 66 can be easily detachable with respect to the spring bar 46.

It is preferable that the cover member 66 is provided with a chamfer portion 76 which is formed by chamfering both end edge portions of the cover member 66. Accordingly, it is possible to suppress deterioration of the band 12 due to contact between the band 12 and the chamfer portion 76 of the cover member 66. A chamfering process is a method for shaving a corner of a member into a corner surface or a rounded surface, including rounded-off chamfering or chamfering with a specified angle. The chamfer portion 76 is provided with a curved portion at the edge portion of the cover member 66 in a case of the rounded-off chamfering. Moreover, when the chamfer with a specified angle is performed the chamfer portion 76 is provided with a surface forming the specified angle with respect to the outer surface of the cover member 66.

It is preferable that a distance t1 between the cover member 66 and the exterior case 10 is longer than a dimension t2 of the band 12 in a thickness direction, as shown in FIG. 3. The dimension t2 of the band 12 in the thickness direction is a thickness of the band 12. Accordingly, the band 12 can be easily attached.

Furthermore, a distance t1 between the cover member 66 and the exterior case 10 may be shorter than the dimension t2 of the band 12 in the thickness direction. The dimension t2 of the band 12 in the thickness direction is a thickness of the band 12. Accordingly, the exterior case 10 can be stably held with respect to the band 12.

It is preferable that the cover member 66 is provided with a notch portion 70, in which a part of the both end edge portions of the cover member 66 is cut out. The notch portion 70 includes a groove or a slit, which is provided in a long axis direction of the cover member 66 from the edge portion of the cover member 66. Accordingly, the spring bar 46 can be easily detachable with respect to the bows 44 by inserting a jig (not shown) for the spring bar from the notch portion 70. The spring bar 46 also can be easily removed when the bow hole 48 is a sac hole not penetrating the bow 44. The notch portion 70 may be provided at the only one end edge portion of the cover member 66. Furthermore, the notch portion 70 may not be provided.

Figure 5:
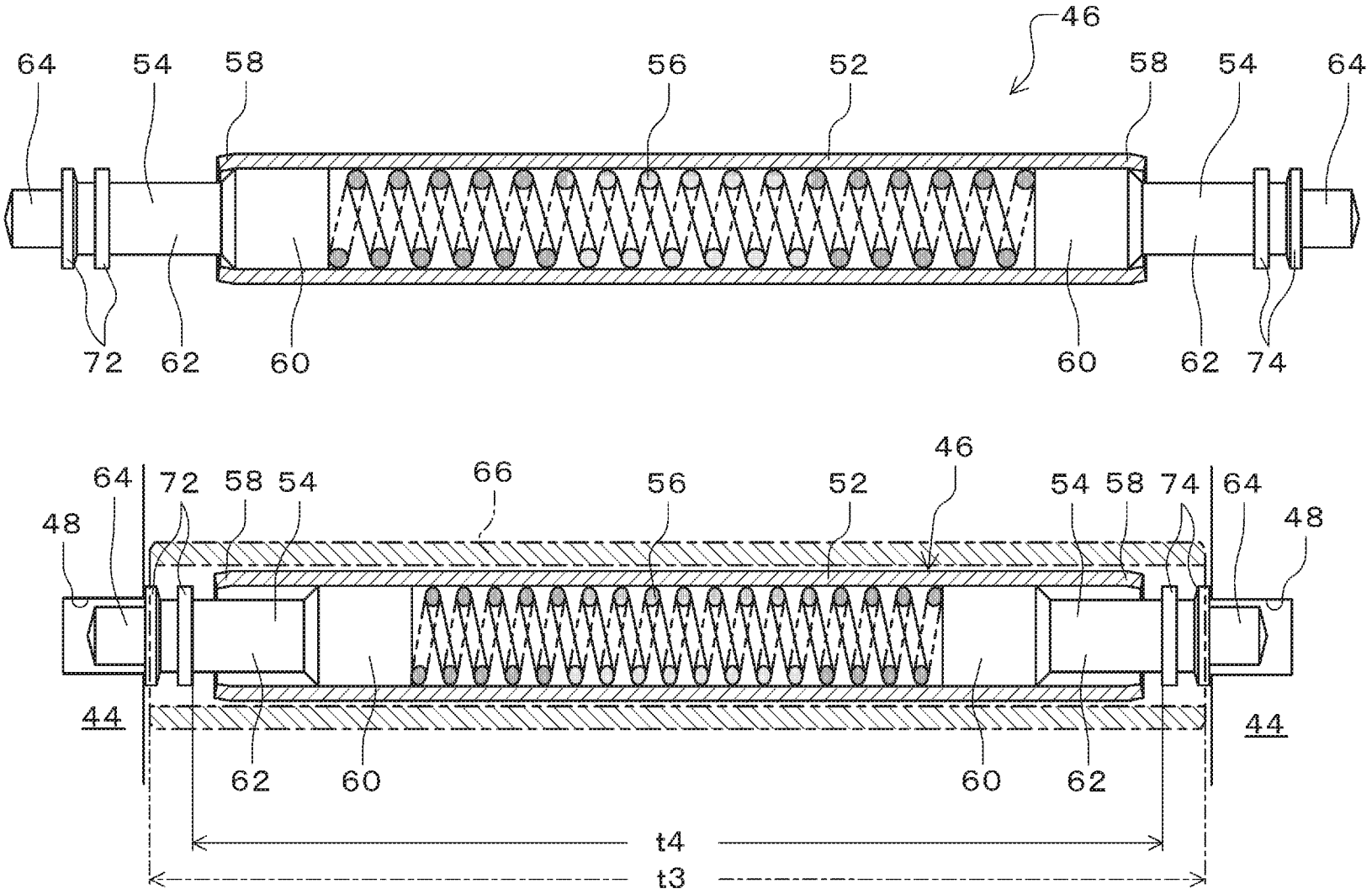
FIG. 5 is a cross-sectional view illustrating a spring bar connecting bows and a band according to the embodiment.

The spring bar 46 is provided with a pin 54 as an expandable portion on which a first flange 72 and a second flange 74 are provided (see FIG. 5). It is preferable that a dimension t3 of the cover member 66 in a longitudinal direction is longer than a distance t4 (see FIG. 5) between the first flange 72 and the second flange 74 when the pin 54 expands and contracts. Accordingly, it is possible to suppress deterioration of the band 12 due to contact between the band 12 and the flanges 72 and 74.

Furthermore, the dimension t3 of the cover member 66 is set to, for example, 21.85 mm in a case where a width between the pair of bows 44 of the exterior case 10 is 22.05 mm, whereby a gap between the both ends of the cover member 66 and the corresponding bow 44 is 10 mm.

An inner diameter ϕ1 of the cover member 66 is set to a dimension so that the cover member 66 is smoothly rotatable with respect to the spring bar 46, e.g. 2.10 mm in a case where an outer diameter of the spring bar 46 is 1.80 mm.

An outer diameter ϕ2 of the cover member 66 is set to a dimension so that the band 12 can be inserted between the cover member 66 and the exterior case 10, e.g. 2.70 mm.

It is preferable that the exterior case 10, the spring bar 46 and the cover member 66 are made of the titanium material in a case where the magnetic sensor 50 is built in the exterior case 10. Accordingly, the magnetic sensor 50 can be hardly influenced by the magnetic field.

A titanium material or an SUS material can be selected as the material of the cover member 66 and the spring bar 46. However, the titanium material less influenced by the magnetic field may be appropriate in a case where the compass mode for indicating the azimuth is installed. In addition to the titanium material, a hardly magnetized material may be also appropriate, such as glass, ceramics, resin, and the like.

Configuration of Spring Bar

FIG. 5 is a cross-sectional view illustrating the spring bar 46 connecting the bows 44 and the band 12 according to the embodiment.

The spring bar 46 is provided with a cylindrical pipe 52, a pair of pins 54 which are inserted into both ends of the pipe 52, respectively, and a spring 56 which is disposed between the pair of pins 54 inside the pipe 52 and urges the pins 54 on the both ends toward an outer circumference of the pipe 52. The spring bar 46 is covered with the cover member 66 made of a non-magnetic material.

The pipe 52 is a titanium pipe made of a pure titanium material which is a hardly magnetized non-magnetic material. An opening end portion 58 of the pipe 52 is processed to be bent toward a center axis of the pipe 52 so that a diameter of the opening is smaller than an inner diameter of the pipe 52. The opening end portion 58 is engaged with a stepped portion of the pin 54 (a portion between a large diameter portion 60 and a small diameter portion 62, which will be described later), thereby preventing the pins 54 from detaching from the pipe 52.

Each pin 54 is made of the titanium material such as a titanium alloy which is a hardly magnetized non-magnetic material. Each pin 54 is provided with a large diameter portion 60, a small diameter portion 62, a first flange 72 (a second flange 74), and an insertion portion 64.

The large diameter portion 60 is a portion disposed in the pipe 52 and in contact with the spring 56, of which a diameter is set to larger than a dimension of the opening of the opening end portion 58 of the pipe 52.

The small diameter portion 62 is formed continuously with the large diameter portion 60 and is set to a diameter smaller than the dimension of the opening of the opening end portion 58. Therefore, the small diameter portion 62 passes through the opening of the opening end portion 58 and protrudes to the outside of the pipe 52.

Two first flanges 72 and two second flanges 74 are respectively formed at an end portion of the small diameter portion 62 at intervals in an axial direction. Each of the first and second flanges 72, 74 has a diameter larger than the small diameter portion 62. Furthermore, Each of the first and second flanges 72, 74 has a dimension larger than the opening of the opening end portion 58, thus the first and second flanges 72, 74 are configured to come into contact with the opening end portion 58 upon pushing the pin 54 into the pipe 52, thereby preventing the pin 54 from being further pushed into the pipe 52. Furthermore, the first and second flanges 72, 74 are configured to have a dimension larger than an opening dimension of the bow hole 48 so that the first and second flanges 72, 74 come into contact with the bows 44 when the insertion portion 64 is inserted into the bow hole 48.

The insertion portion 64 is formed continuously with the first and second flanges 72, 74, and has a diameter smaller than that of the small diameter portion 62. The insertion portion 64 is configured to have a dimension so that the insertion portion 64 can be inserted into the bow hole 48 of the pair of bows 44. The pin 54 in this configuration is capable of smoothly moving forward and backward along an axial direction of the pipe 52.

The spring 56 is a coil spring made of a SPRON material (registered trademark). The SPRON material is a cobalt-nickel alloy, which is a non-magnetic material having a spring property (elasticity) that is hardly magnetized. Furthermore, the spring 56 is not limited to the SPRON material, and may be acceptable as long as it is an elastic non-magnetic material that is hardly magnetized.

In the spring bar 46 configured as described above, the pin 54 is capable of moving forward and backward between a state where the pin 54 is urged by the spring 56 and thus the small diameter portion 62 protrudes to the outside of the pipe 52, as shown in the upper part of FIG. 5, and a state where the pin 54 is pushed toward the inside of the pipe 52 and thus the first and second flanges 72, 74 come into contact with the opening end portion 58 (not shown) of the pipe 52. The lower part of FIG. 5 shows a state where the spring bar 46 and the cover member 66 are provided between the pair of bows 44.

The spring bar 46 is inserted into the cover member 66 and provided between the pair of bows 44. The spring bar 46 is covered by being inserted into the cover member 66 which is a metallic pipe made of the SUS material or the titanium material. Accordingly, the first and second flanges 72, 74 of the pin 54 of the spring bar 46 are not exposed to the outside, and the band 12 is inserted through in contact with the cover member 66.

Since the spring bar 46 is covered by the cover member 66, it is possible to prevent the first and second flanges 72, 74 of the spring bar 46 from being exposed and being brought into contact with the band 12. Therefore, it is also possible to prevent the band 12 from being stuck with the flanges 72, 74 and thus being torn.

Furthermore, since the spring bar 46 and the cover member 66 are configured to the non-magnetic material, it is possible to prevent the spring bar 46 and the cover member 66 from being magnetized, thus the magnetic sensor 50 can detect the correct orientation and the correct orientation is indicated by the orientation indicator 34.

The spring bar 46 is attached to the bows 44 by fitting a dedicated jig between the first flange 72 and the second flange 74, pushing the flanges 72, 74 inwardly, and putting back the pin 54 into the pipe 52 against the spring force of the spring 56, so that the overall dimension of the spring bar 46 is shortened and a tip portion of the pin 54 is fitted into the bow hole 48 in this state.

Furthermore, it is necessary to detach the spring bar 46 to exchange the band 12 for wearing. Similarly to a case when the spring bar 46 is attached to the bows 44, the tip portion of the pin 54 can be removed from the bow holes 48 by pushing the flanges 72, 74 inwardly with the dedicated jig and contracting the pin 54 to the inside of the pipe 52.

A process of connecting the band 12 to the bows 44 of the exterior case 10 using the spring bar 46 will be described.

First, the spring bar 46 is inserted into the cover member 66.

While the pin 54 is pushed into the pipe 52, the cover member 66 and the spring bar 46 are disposed between the pair of bows 44. The insertion portion 64 is aligned with a position of the bow hole 48 and the pushing force for the pin 54 is weakened, thus the pin 54 moves outwardly by the biasing force of the spring 56 and the insertion portion 64 is inserted into the bow hole 48. In a state where the cover member 66 is mounted on the spring bar 46, the spring bar 46 is fixed to the exterior case 10. The spring bars 46 on which the cover members 66 are mounted are fixed at positions of the bow holes 48 of the exterior case 10 at twelve o'clock and six o'clock.

The band 12 is drawn through the spring bars 46 on which the cover members 66 are mounted. The band 12 is put between the cover member 66 and the exterior case 10 (twelve o'clock side), and the band 12 is passed between the other cover member 66 (six o'clock side) and the exterior case 10 through a side of the back cover 40. A length of the band 12 can be adjusted by a buckle (not shown).

When the cover member 66 and the spring bar 46 are removed, the jig is inserted from the bow hole 48 to move the pin 54 to the inside of the pipe 52, thereby removing the pin 54 from the bow hole 48. Accordingly, the engagement between the spring bar 46 and the bow hole 48 is released, and the cover member 66 and the spring bar 46 can be removed from the bows 44.

Advantageous Effects of Embodiment

According to such an embodiment, the following advantageous effects can be obtained.

Since the friction between the spring bar 46 and the band 12 can be suppressed due to the cover member 66 which is mounted on the spring bar 46, it is possible to reduce deterioration of the band 12. Furthermore, the band 12 made of a nylon synthetic resin or a polyamide synthetic fiber is not stuck with the spring bar 46, thus the band 12 is not torn up.

When the band 12 is drawn through the exterior case 10, at least one of the following advantageous effects can be achieved by disposing the cover member 66 to the outside of the spring bar 46: suppressing tear of the band 12 and improved product appearance. The band 12 is smoothly drawn through by rotating the cover member 66, and thus installability can be improved. The band 12 is not limited to a pull-through band, and the band 12 can be prevented from tearing up even when the cover member 66 is inserted into a cylindrical portion provided at one end of the band 12.

It is possible to improve the appearance of functional units by decorating patterns or characters (character strings) 84 on a surface of the cover member 66 with a laser (not shown) or the like (see FIG. 4). Additionally, since the bows 44 and the band 12 are connected using the spring bar 46, the bow hole 48 can be configured to have a smaller diameter and thus the designability is also improved as compared with a case where they are connected using screw pins made of the titanium material.

The pipe 52 and pin 54, made of the titanium material, and the spring 56, made of the SPRON material, are used as the spring bar 46 for connecting the band 12 to the bows 44, thus the spring bar 46 is configured with the hardly magnetized material. Therefore, the spring bar 46 is hardly magnetized, and the azimuth can be detected by the magnetic sensor 50 less influenced by the magnetic field of the spring bar 46, thereby improving indication accuracy of the orientation indicator 34.

The spring bars 46 can be shared. Since the spring bars 46 are common, a metallic band or a fix-fitting leather band can be attached by removing the cover members 66.

It should be noted that, in a case where a spring bar without flanges is used as the spring bar for the band 12, the cover member 66 is not required. However, the titanium spring bar 46 is expensive, thus it is difficult to prepare several types of spring bars 46 with or without flanges as well as various width dimension of the pair of the bows 44. Meanwhile, the spring bar 46 can serve for both a typical band and the band 12 by providing the cover member 66, thus the various types of the spring bar 46 are not required and cost is reduced.

Other Embodiments

The invention is not limited to the embodiment stated above, and various modifications can be made within the scope of the appended claims of the invention.

First Modification Example

Figure 6:
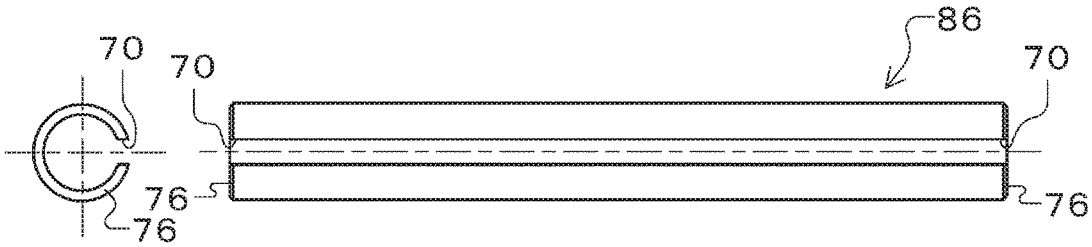
FIG. 6 shows a front view and a side view each of which illustrates a cover member of a first modification example.

FIG. 6 shows a front view and a side view each of which illustrates a cover member 86 of a first modification example.

The notch portions 70 at both ends of the cover 86 may be continuous, as shown in FIG. 6. In particular, a cross-section perpendicular to a longitudinal direction of the cover member 86 may be in a C-shape.

Second Modification Example

Figure 7:
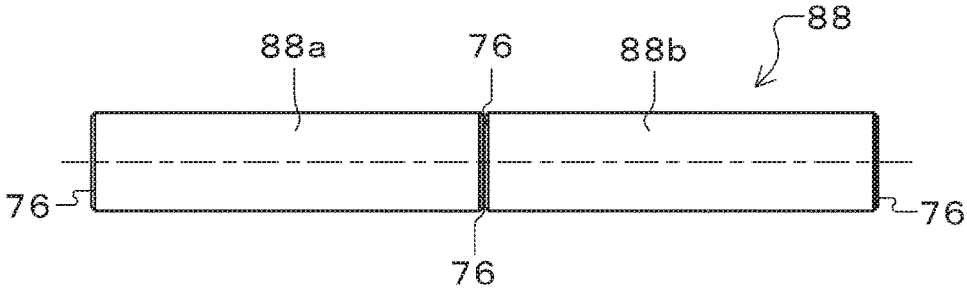
FIG. 7 is a front view illustrating a cover member of a second modification example.

FIG. 7 is a front view illustrating a cover member 88 of a second modification example.

The cover member 88 is configured to have a cover member 88*a* and a cover member 88*b* which are not connected to each other, as shown in FIG. 7. Accordingly, the cover member 88*a* and the cover member 88*b* can be separately rotated with respect to the spring bar 46, thus the band 12 can be smoothly drawn through and the installability can be improved. In the second modification example, the cover member 88 is configured to have two pieces, i.e., the cover member 88*a* and the cover member 88*b*, but may be configured to have three or more pieces.

Additionally, it is preferable that the cover member 66 has a cylindrical shape but not limited thereto. The cover member 66 may have a polygonal cylindrical shape or any other cylindrical shape.

Third Modification Example

Figure 8:
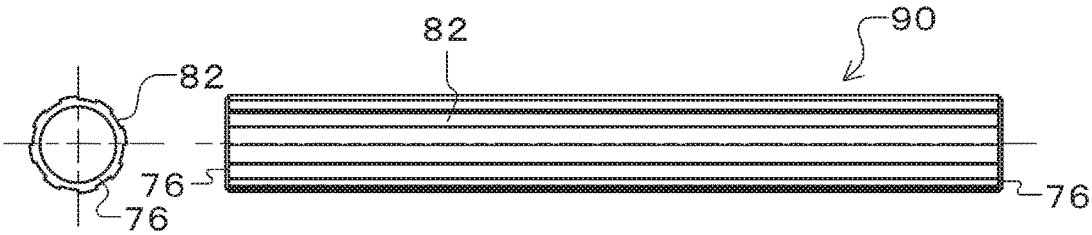
FIG. 8 shows a front view and a side view each of which illustrates a cover member of a third modification example.

FIG. 8 shows a front view and a sectional view each of which illustrates a cover member 90 of a third modification example.

The cover member 90 may be configured so that several grooves 82 are cut in the axial direction and a cross-section perpendicular to a longitudinal direction of the cover member 86 looks like a gear, as shown in FIG. 8. Accordingly, a contact area between the cover member 90 and band 12 becomes smaller, thus the band 12 can be smoothly drawn through and the installability can be improved.

Fourth Modification Example

Each of FIGS. 9 to 12 is a sectional view illustrating respective cover members 92 to 98 according to a fourth modification example.

Figure 9:
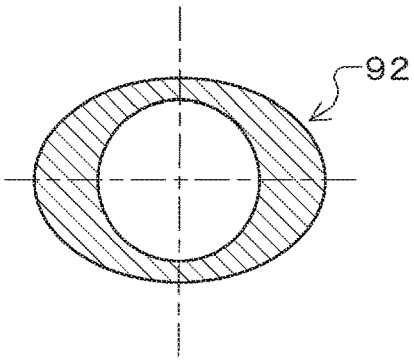
FIG. 9 is a cross-sectional view illustrating a cover member of a fourth modification example.

For example, the cover member 92 may have an elliptical outer peripheral shape of a cross-section perpendicular to a longitudinal direction of the cover member 92, as shown in FIG. 9.

Figure 10:
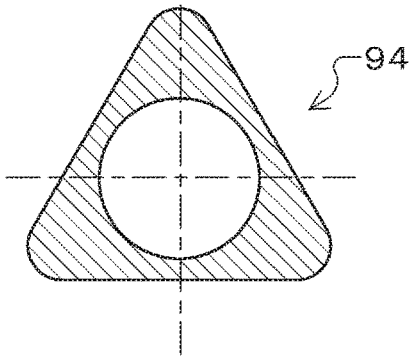
FIG. 10 is a cross-sectional view illustrating the cover member of the fourth modification example.

The cover member 94 may have a triangular outer peripheral shape of a cross-section perpendicular to a longitudinal direction of the cover member 94, as shown in FIG. 10.

Figure 11:
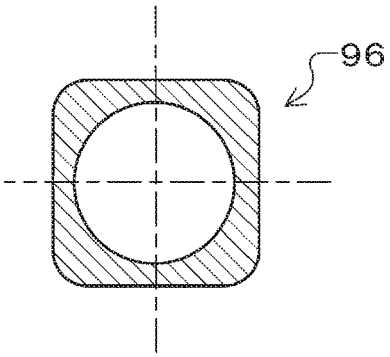
FIG. 11 is a cross-sectional view illustrating the cover member of the fourth modification example.

The cover member 96 may have a quadrangular outer peripheral shape of a cross-section perpendicular to a longitudinal direction of the cover member 96, as shown in FIG. 11.

Figure 12:
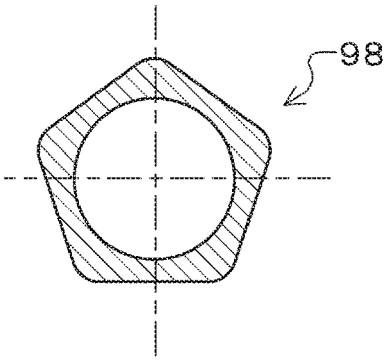
FIG. 12 is a cross-sectional view illustrating the cover member of the fourth modification example.

The cover member 98 may have a pentagonal outer peripheral shape of a cross-section perpendicular to a longitudinal direction of the cover member 98, as shown in FIG. 12.

In the description stated above, an inner peripheral shape of a cross-section perpendicular to the longitudinal direction of each of the cover members 66, and 86 to 98, is a circular shape, but may be a shape other than the circular shape. For example, the inner peripheral shape of the cross-section perpendicular to the longitudinal direction of each of the cover members 92 to 98, may be the same shape as the outer peripheral shape. Furthermore, a center of the inner peripheral shape and a center of the outer peripheral shape, of the cross-section perpendicular to the longitudinal direction of each of the cover members 66, and 86 to 98, may be deviated from each other.

The cover members 66, and 86 to 98 can be adopted in various small devices using the band 12.

Although the spring bar 46 may be configured as a spring bar without flanges, in this case, the installability to the exterior case would be worse. For example, since the spring bar is fixed to the exterior case by grasping the flanges with the jig, the jig cannot be used for the spring bar without flanges. The bow hole needs to be configured as a through-hole because the spring bar cannot be removed if the bow hole is a sac hole not penetrating the bow. Furthermore, the spring bar is required for more complex specifications.

The followings are facts derived from the embodiment.

A watch includes a case; a first spring bar support portion and a second spring bar support portion which are provided at one end of the case; a spring bar supported by the first spring bar support portion and the second spring bar support portion; a cover member into which the spring bar is inserted and which is disposed between the first spring bar support portion and the second spring bar support portion; and a band disposed between the cover member and the case. Accordingly, it is possible to suppress friction between the spring bar and the band and to decrease deterioration of the band.

It is preferable that a magnetic sensor is housed in the case, and the case, the spring bar, and the cover member are made of a titanium material. Accordingly, the magnetic sensor can be hardly influenced by the magnetic field.

It is preferable that the case includes a back cover and a cover glass, and the cover member is provided between an imaginary plane extending from an outer surface of the back cover and an imaginary plane extending from an outer surface of the cover glass. Accordingly, the band is curved between the case and the cover member, thus the case can be stably held with respect to the band.

It is preferable that the spring bar has a chamfer portion at an end edge portion of the cover member. Accordingly, it is possible to suppress deterioration of the band due to contact between the both end edge portions of the cover member and the band.

It is preferable that a distance between the cover member and the case is longer than a dimension in a thickness direction of the band. Accordingly, the band can be easily attached.

It is preferable that a distance between the cover member and the case is shorter than a dimension in a thickness direction of the band. Accordingly, the case can be stably held with respect to the band.

It is preferable the cover member has a cylindrical shape. Accordingly, the cover member can be easily detachable with respect to the spring bar.

It is preferable the cover member has a notch portion at an end edge portion. Accordingly, the spring bar can be easily detachable with respect to the first spring bar support portion and the second spring bar support portion by inserting a jig for the spring bar from the notch portion.

It is preferable that the spring bar includes expandable portions which are provided with a first flange and a second flange, respectively, and a dimension of the cover member in a longitudinal direction is longer than a distance from the first flange to the second flange when the expandable portions expand and contract. Accordingly, it is possible to suppress deterioration of the band due to contact between the band and the first and second flanges.

What is claimed is:

1. A watch, comprising:

a case;

a first spring bar support portion and a second spring bar support portion, each of which are provided at an end of the case;

a spring bar that is supported by the first spring bar support portion and the second spring bar support portion;

a cover member into which the spring bar is inserted, the cover member disposed between the first spring bar support portion and the second spring bar support portion, the cover member entirely surrounding a circumference of the spring bar; and a band disposed between the cover member and the case, wherein:

the spring bar includes a first pin having a plurality of first flanges, a second pin having a plurality of second flanges, and a spring disposed between the first pin and the second pin, and a dimension of the cover member in a longitudinal direction is equal to or longer than a distance between one of the plurality of first flanges closest to the first spring bar support portion and one of the plurality of second flanges closest to the second spring bar support portion when the spring bar is supported by the first spring bar support portion and the second spring bar support portion.

2. The watch according to claim 1, further comprising:

a magnetic sensor housed in the case, wherein the case, the spring bar, and the cover member are made of a titanium material.

3. The watch according to claim 1, wherein the case includes a back cover and a cover glass, and the spring bar is provided between an imaginary plane extending from an outer surface of the back cover and an imaginary plane extending from an outer surface of the cover glass.

4. The watch according to claim 1, wherein the cover member includes a chamfer portion at an end edge portion of the cover member.

5. The watch according to claim 1, wherein a distance between the cover member and the case is longer than a dimension of the band in a thickness direction.

6. The watch according to claim 1, wherein a distance between the cover member and the case is shorter than a thickness of the band.

7. The watch according to claim 1, wherein the cover member has a cylindrical shape.

8. The watch according to claim 1, wherein the cover member has a notch portion at an end edge portion of the cover member.

9. The watch according to claim 1, wherein the spring bar includes a cylindrical pipe, each of the first pin and the second pin including a large diameter portion and a small diameter portion, the small diameter portion formed continuously with the large diameter portion, the large diameter portion having a diameter larger than a dimension of an opening of an opening end portion of the pipe, the small diameter portion having a diameter smaller than the dimension of the opening of the opening end portion of the pipe, the small diameter portion including the plurality of first flanges and the plurality of second flanges each having a diameter larger than the small diameter portion and larger than the opening of the opening end portion.

10. A watch, comprising:

a case;

a first spring bar support portion and a second spring bar support portion, each of which are provided at an end of the case;

a spring bar that is supported by the first spring bar support portion and the second spring bar support portion;

a cover member into which the spring bar is inserted, the cover member disposed between the first spring bar support portion and the second spring bar support portion, the cover member having a cylindrical shape; and a band disposed between the cover member and the case, wherein:

the spring bar includes a first pin having a plurality of first flanges, a second pin having a plurality of second flanges, and a spring disposed between the first pin and the second pin, and a dimension of the cover member in a longitudinal direction is equal to or longer than a distance between one of the plurality of first flanges closest to the first spring bar support portion and one of the plurality of second flanges closest to the second spring bar support portion when the spring bar is supported by the first spring bar support portion and the second spring bar support portion.

11. A wearable apparatus, comprising:

an external case;

a spring bar supported by a plurality of support portions including a first spring bar support portion and a second spring bar support portion;

a cover member having a hollow portion, the spring bar provided within the hollow portion of the cover member, the cover member entirely surrounding a circumference of the spring bar; and a band configured to be inserted through a space between the cover member and the external case, the spring bar includes a first pin having a plurality of first flanges, a second pin having a plurality of second flanges, and a spring disposed between the first pin and the second pin, and a dimension of the cover member in a longitudinal direction is equal to or longer than a distance between one of the plurality of first flanges closest to the first spring bar support portion and one of the plurality of second flanges closest to the second spring bar support portion when the spring bar is supported by the first spring bar support portion and the second spring bar support portion.

12. The wearable apparatus according to claim 11, wherein the cover member is provided with a chamfer portion formed by chamfering both end edge portions of the cover member.

13. The wearable apparatus according to claim 11, wherein the band is curved between the exterior case and the cover member.

14. The wearable apparatus according to claim 11, wherein the cover member has a cylindrical shape.

* * * * *